United States Patent [19]

Nishikubo et al.

[11] 4,293,939

[45] Oct. 6, 1981

[54] ELECTRONIC TIMEPIECE HAVING AN ALARM SYSTEM

[75] Inventors: Yasuhiko Nishikubo, Iruma; Mitsuo Sekine, Tokorozawa, both of Japan

[73] Assignee: Citizen Watch Company Limited, Tokyo, Japan

[21] Appl. No.: 921,956

[22] Filed: Jul. 5, 1978

[30] Foreign Application Priority Data

| | | | |
|---|---|---|---|
| Jul. 8, 1977 | [JP] | Japan | 52/81803 |
| Jul. 25, 1977 | [JP] | Japan | 52/89117 |
| Jul. 27, 1977 | [JP] | Japan | 52/89982 |

[51] Int. Cl.[3] ..... G04B 23/02; G04C 21/16

[52] U.S. Cl. ..... 368/74; 368/251

[58] Field of Search ..... 58/19 R, 23 R, 38, 39.5, 58/39, 50 R, 57.5, 127 C, 152 B; 368/72–74, 109, 250–251

[56] References Cited

U.S. PATENT DOCUMENTS

| | | | |
|---|---|---|---|
| 3,662,535 | 5/1972 | Hedrick et al. | 58/125 C |
| 3,813,533 | 5/1974 | Cone et al. | 58/50 R |
| 4,074,516 | 2/1978 | Kondo | 58/152 B |
| 4,110,969 | 9/1978 | Fukuichi | 58/57.5 |
| 4,196,583 | 4/1980 | Komaki | 368/73 |

*Primary Examiner*—Vit W. Miska

*Attorney, Agent, or Firm*—Holman & Stern

[57] ABSTRACT

In an electronic timepiece having an analog type of time display by means of hours and minutes hands, an alarm system is provided which functions electronically and independently of the analog display system. An alarm signal is generated when the time duration counted by an alarm timekeeping circuit coincides with an alarm time stored in an alarm time memory circuit, said alarm time being set by the timepiece user actuating a switch.

2 Claims, 6 Drawing Figures

OSCILLATOR
10
FREQUENCY DIVIDER
12
DRIVER CIRCUIT
14
MOTOR
16
GEAR TRAIN
18
HANDS
20
15

ALARM TIMEKEEPING CIRCUIT
22
COINCIDENCE DETECTION CIRCUIT
23
ALARM
30
ALARM TIME MEMORY CIRCUIT
24
GATE
26
SWITCH
28

ELECTRONIC TIMEPIECE HAVING AN ALARM SYSTEM

BACKGROUND OF THE INVENTION

This invention relates to analog display type electronic timepieces equipped with an alarm function, and more particularly to an analog display type electronic timepiece having an alarm system which is completely independent of the analog display system and functions electronically.

In an electronic timepiece having an analog type of time display, the hours and minutes of the current time are displayed by the positions of an hours hand and a minutes hand which are driven through a gear train by a motor, the motor being of a synchronous type such as a stepping motor and driven by a signal of fixed frequency, generally derived from a quartz crystal oscillator circuit by frequency division. There have been various methods proposed for equipping such a timepiece with an alarm function, whereby an audible and/or visible alarm signal is generated at some time designated by the timepiece user. These proposals generally however involve some mechanical or electro-mechanical coupling to the analog type time display system, and are complex and difficult to implement.

With the method of the present invention, an alarm system is provided for an analog type electronic timepiece which is completely independent of the analog time display system. To have an alarm signal generated at some desired point of time in the future, the timepiece user simply sets into an alarm time memory circuit the time difference between the current time and the desired alarm time point. This setting is performed by actuating a switch. Other than this switch, and an alarm buzzer if required, no other mechanical components are required so that the system of the present invention can easily be added to an existing design of analog type electronic timepiece. Some type of optical display means can also be incorporated, however, to indicate the face that the timepiece is in the alarm time setting mode of operation, although it is also possible to use the alarm buzzer for this purpose. In addition, a duel-function switch can be incorporated, so that the hours and minutes of the alarm time can be set independently.

It is therefore an object of the present invention to provide an improved type of electronic timepiece of analog display type equipped with an alarm function.

More particularly, it is an object of the present invention to provide an improved type of electronic timepiece of analog display type equipped with an alarm system which is independent of the analog display system of said timepiece.

BRIEF DESCRIPTION OF THE DRAWINGS

These and other objects, features and advantages of the present invention will be made more apparent by the following description, when taken in conjunction with the accompanying figures, wherein.

DESCRIPTION OF THE PREFERRED EMBODIMENTS

Figures 1, 2:
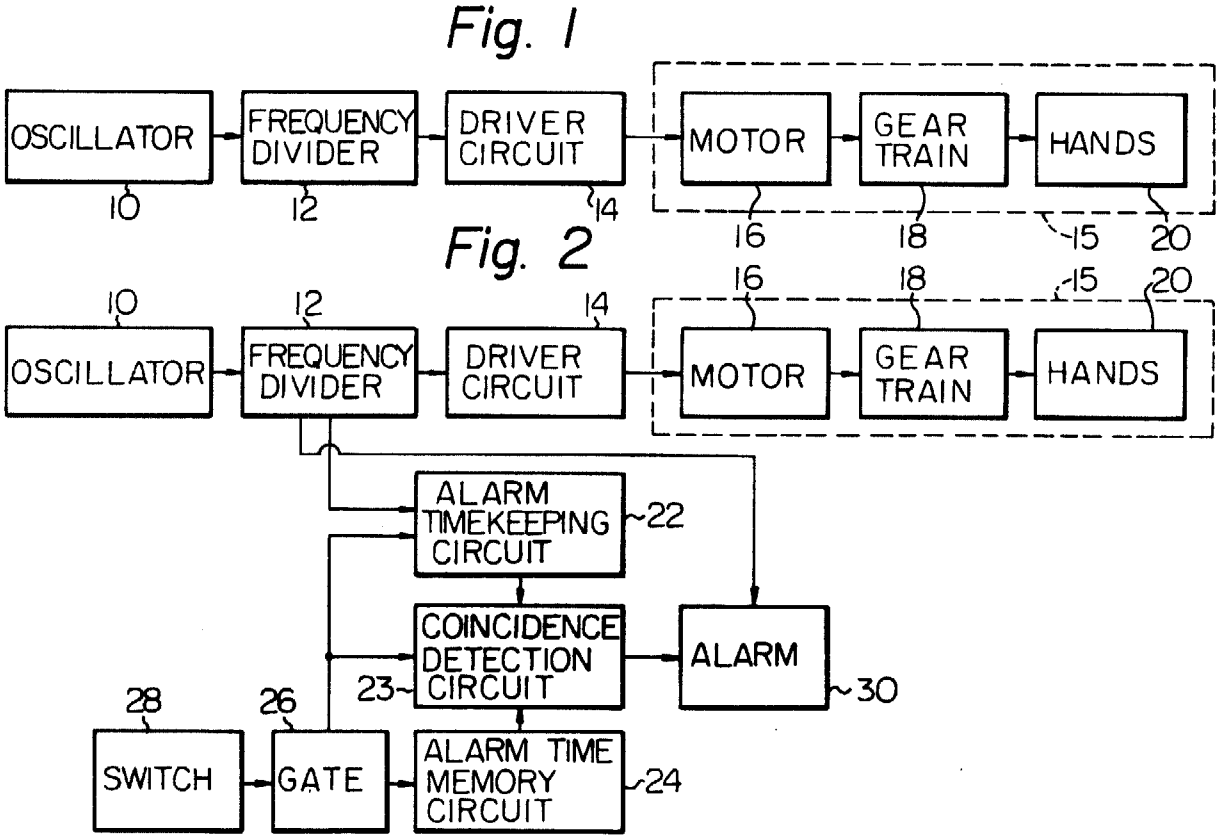
FIG. 1 is a block diagram of the configuration of an analog type electronic timepiece of conventional design.
FIG. 2 is a general block diagram of a first preferred embodiment of the present invention.

Referring now to FIG. 1, a general block diagram is shown therein of an analog display type electronic timepiece of conventional design. An oscillator circuit 10, the frequency of which is generally controlled by a quartz crystal vibrator, provides an input signal for a frequency divider circuit 12, which produces a standard timekeeping signal at a frequency of 1 Hz. This standard timekeeping signal is applied to a drive circuit 14, which produces a drive signal for a motor 16. This drive signal causes the motor to drive the hours and minutes hands 20 of the timepiece through gear train 18 so that time is displayed by these hands. The electro-mechanical components of this timepiece, which constitute the analog display system, are shown by numeral 15, within the broken line in FIG. 1.

FIG. 2 shows the general configuration of a first preferred embodiment of the present invention. Numeral 10 to 20 indicate identical components and circuit blocks in both FIG. 1 and FIG. 2. The configuration shown in FIG. 2 includes, in addition to components 10 to 20 of the analog type electronic timepiece shown in FIG. 1, an alarm system comprising a switch 28, a gate circuit 26, an alarm timekeeping circuit 22, an alarm time memory circuit 24, a coincidence detection circuit 23, and an alarm unit 30. It can be seen that the alarm system is coupled to frequency divider 12, but is completely independent of analog display system 15. Alarm timekeeping circuit 22 consists of a circuit for counting seconds, minutes and hours of time in response to a high frequency standard frequency signal applied from frequency divider 12. When the timepiece user actuates switch 28 in order to set the timepiece into an alarm time setting mode, in which an alarm time can be set into alarm time memory circuit 24, the contents of alarm timekeeping circuit 22 are reset to zero. The operation of coincidence detection circuit 23 is also halted by the actuation of switch 28. The timepiece user can then set the required alarm time into alarm time memory circuit 24. This alarm time is equal to the difference between the current time, as indicated by the timepiece hands, and the point in time at which it is desired to have the alarm signal emitted. If, for example, the current time is 2 p.m and it is desired to have an alarm signal generated at 7 p.m., then the user would set in an alarm time of 5 hours into alarm time memory circuit 24. The setting of an alarm time is performed by successive actuation of switch 28 when the timepiece is in the alarm time setting mode. When setting of the alarm time has been completed, the user puts the timepiece back into the normal timekeeping mode of operation by actuating switch 28 in a prescribed manner. Alarm timekeeping circuit 22 now is released from the reset condition, and begins to count the hours and minutes of time. Eventually, when the contents of alarm timekeeping circuit 22 become identical to the contents stored in alarm time memory circuit 24, i.e. when both contents coincide, this is detected by coincidence detection circuit 23, which generates an output signal. This output signal actuates alarm unit 30, causing an audible or visible alarm warning signal to be generated.

It will be apparent that, since the standard frequency signal which is applied to alarm timekeeping circuit 22 is separate from the standard frequency signal applied to drive circuit 14 from frequency divider circuit 12, the operation of alarm timekeeping circuit 22 will be completely unaffected by any interruption of the standard frequency signal applied to drive circuit 14. Such an interruption could occur, for example, in the process of setting the timepiece hands 20 to indicate the correct current time. This ensures that an extremely simple configuration for the alarm system is possible by the method of the present invention, since no complicated measures are required to guard against such interruptions having an effect upon the operation of the alarm system.

Figure 3:
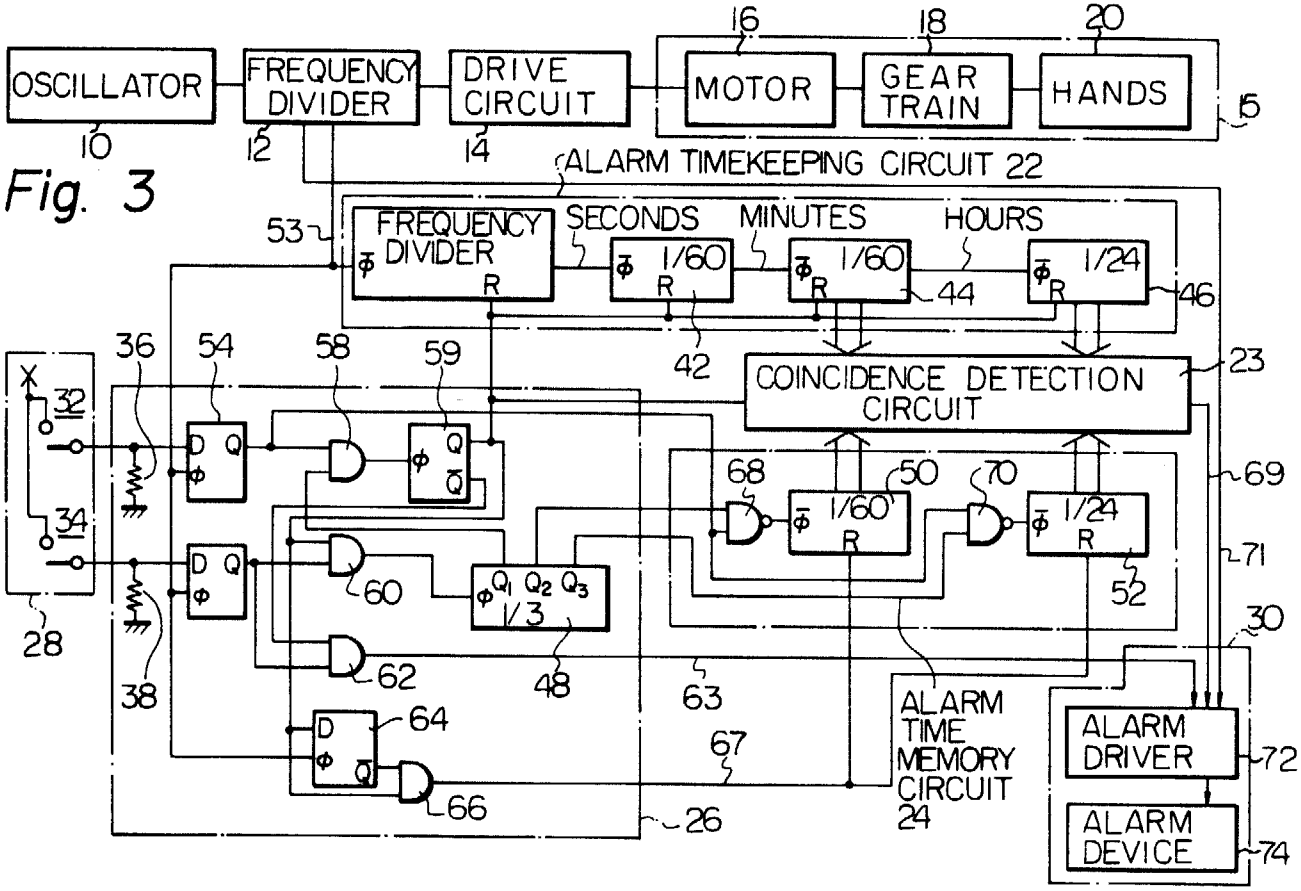
FIG. 3 is a general circuit block diagram illustrating details of the alarm system in the first preferred embodiment of the present invention.

The general configuration of the first preferred embodiment of the present invention is shown in greater detail in FIG. 3. In FIG. 3, circuit blocks and components having the same numerals as in FIG. 2 perform identical functions to the corresponding circuit blocks or components. The timepiece hands 20 are driven through gear train 18 by a motor 16, which is driven by a signal supplied by drive circuit 14. Drive circuit 14 is operated by drive signal pulses at a frequency of 1 Hz supplied from frequency divider 12.

With this embodiment of the present invention, the hours and minutes of alarm time can be set independently of one another. This is done by actuation of switch 28, which is a dual-function switch comprised of switch 32 and switch 34. When an external portion of switch 28 is rotated in one direction to a predetermined position, then it becomes possible to actuate switch 32. When the external portion of switch 28 is rotated in the opposite direction to a predetermined position, then it becomes possible to actuate switch 28.

Alarm timekeeping circuit 22 consists of a frequency divider circuit 40, a seconds counter 42, a minutes counter 44, and an hours counter 46. A high-frequency signal is output from frequency divider 12 on line 53 and applied to the input terminal of frequency divider 40. Line 53 is also connected to the clock terminals of data-type flip-flops 54, 56 and 64. Frequency divider 40 generates an output signal with a frequency of 1 Hz which is applied to seconds counter 42. Seconds counter 42 produces an output signal at a frequency of 1 cycle per minute, which is applied to minutes counter 44. Minutes counter 44 produces an output signal with a frequency of one cycle per hour which is applied to hours counter 46. Hours counter 46 produces an output signal with a period of 24 hours. It will thus be apparent that the alarm timekeeping circuit 22 is an electronic timekeeping circuit which is completely independent of and separate from the analog time display system of the timepiece.

The operation of ⅓ divider circuit 48 will now be described. This is a circuit having three outputs Q1, Q2 and Q3. These outputs go consecutively to the H logic level, one at a time, as successive transitions of an input signal applied from AND gate 68 occur. The relationship between the logic levels of Q1, Q2 and Q3 and the input signal transitions are shown in the following chart.

| $\phi$ | Q1 | Q2 | Q3 | Operating Mode |
|---|---|---|---|---|
| | H | L | L | Normal timekeeping mode |
| | L | H | L | Minutes setting mode |
| | L | L | H | Hours setting mode |

H ..... High potential
L ..... Low potential

A contact of switch 32 is connected to the data terminal of data-type flip-flop 54. This data terminal is connected to ground via resistor 36, so that when switch 32 is actuated the terminal goes to the H logic level, and when switch 32 is released the data terminal goes to the L level, i.e. to ground potential. Similarly when switch 34 is actuated, the data terminal of data-type flip-flop 56 goes to the H level, and when switch 34 is released, the data terminal goes to the L level. With the timepiece in the normal timekeeping mode, output Q1 of ⅓ divider circuit 48 is at the H level, while Q2 and Q3 are at the L level, as shown in Chart 1 above. At this time, the Q output of toggle-type flip-flop 59 is at the L level. This Q output is connected to the reset terminals of frequency divider circuit 40, seconds counter 42, minutes counter 44 and hours counter 46 in alarm timekeeping circuit 22. In this condition, if switch 32 is actuated, then the data terminal of flip-flop 54 goes to the H level in response to the high frequency signal applied to its clock terminal. At this time, output Q1 is at the H level, so that an H level signal will be output from AND gate 58 which is connected to the clock terminal of toggle-type flip-flop 59. The L to H level transition occurring at the clock terminal of flip-flop 59 will cause the Q output of this flip-flop to go to the H level. As a result, frequency divider circuit 40, seconds counter 42, minutes counter 44 and hours counter 46 in alarm timekeeping circuit 22 will be reset. In addition, an H level signal will be applied from the Q terminal of flip-flop 59 to an input of AND gates 60 and 66, and to the data terminal of data-type flip-flop 64. Prior to this time, the Q output of data-type flip-flop 64 was at the H level, since an L level input was being applied to the data terminal. Thus, before the Q output of flip-flop 64 goes to the L level in response to the next L to H level transition of the clock signal applied to this flip-flop, there will be a short time interval in which an H level signal is applied to both inputs of AND gate 66. An H level signal will therefore be applied from AND gate 66 to the reset terminals of minutes counter 50 and hours counter 52 in alarm time memory circuit 24, resetting these counter. The output of AND gate 66 then returns to the L level. The Q output of flip-flop 59 is also connected to the reset terminal of coincidence detection circuit 23, so that this circuit too is now reset. Thus, setting in of an alarm time can now be performed, with alarm timekeeping circuit 22, coincidence detection circuit 23 and alarm time memory circuit 24 having been reset.

The Q output of flip-flop 56 is connected to one input of AND gate 60, and the Q output of data-type flip-flop 59 is connected to the other input. Thus, if switch 34 is now actuated, the output of AND gate 60 will go from the L level to the H level. As a result, output Q2 of ⅓ divider circuit 48 will go to the H level, as shown in Chart 1. The output of AND gate 58 now goes to the L level, since output Q1 is at the L level, however the Q output of flip-flop 59 remains at the H level. Output Q2 is connected to an input of NAND gate 68. The Q output of flip-flop 54 is connected to the other input of NAND gate 68, and also to an input of NAND gate 70. In FIG. 3, the symbol $\phi$ indicates that the flip-flop or counter to which the symbol applies is actuated on the leading edge of the input clock signal, i.e. when the clock signal goes from the L level to the H level. The symbol $\overline{\phi}$ indicates that the flip-flop or counter concerned is actuated on the falling edge of the input clock signal, i.e. when the clock signal goes from the L level to the H level. If switch 32 is now actuated and released, the output of NAND gate 68 will go from the H level to the L level, and then back to the H level. Thus, minutes counter 50 will be incremented by one minute, i.e. by one count. The circuit is therefore now in the alarm time minutes setting mode. By successive actuation of switch 32, any number of minutes up to 60 can be stored in counter 50.

When setting of the alarm time minutes has been completed, switch 34 is actuated once more, i.e. is depressed and released. As a result, a signal transition from the L level to the H level occurs at the output of AND gate 60, so that output Q3 of ⅓ divider circuit 48 goes to the H level, as shown in Chart 1 above. Output Q3 is connected to an input of NAND gate 70. Thus, if switch 32 is now actuated and released, the output of NAND gate 70 will go from the H level to the L level, and back to the H level. As a result, the hours counter circuit 52 in alarm time memory circuit 24 will be incremented by a count of one hour. In this way, by consecutively actuating and releasing switch 32, any desired number of hours up to 24 can be stored in the hours counter 52 of alarm time memory circuit 24.

When setting of the alarm time hours has been completed, switch 34 is actuated once more, causing a transition to occur from the L level to the H level at the output of AND gate 60 so that output Q1 goes to the H level, as shown in Chart 1. The timepiece is now ready to be set back into the normal timekeeping mode.

At this stage, alarm timekeeping circuit 22 is still being held in the reset condition by the H level of the Q output of flip-flop 59. At the moment when the timepiece user wishes counting of the alarm time to begin, switch 32 is actuated. This causes the output of AND gate 58 to go from the L level to the H level, so that the Q output of toggle-type flip-flop 59 goes to the L level. The reset condition of alarm timekeeping circuit 22 is now released, and this circuit now begins to count in response to the input signal applied on line 53 from frequency divider 12.

Subsequently, when the contents of minutes counter 44 and hours counter 46 in alarm timekeeping circuit 22 become identical to the contents of minutes counter 50 and hours counter 52 in alarm time memory circuit 24, this fact is detected by coincidence detection circuit 23. An output signal is thereby generated by coincidence detection circuit 23 which is applied to alarm drive circuit 72 in alarm unit 30. Alarm drive circuit 72 is thereby actuated to produce a drive signal which is applied to alarm device 74, causing an alarm signal to be generated. The user is thereby notified that alarm time coincidence has occurred.

If the timepiece user wishes to shut off the alarm signal, this can be done by actuating switch 34. This causes the Q output of flip-flop 56 to go to the H level, so that line 63 connected to the output of AND gate 62 goes to the H level. Line 63 is connected to alarm drive circuit 72, and serves to inhibit a drive signal from being generated by alarm drive circuit 72 when it is at the H level. If the user does not shut off the alarm by actuating switch 34, automatic shut-off is performed after a predetermined period of time by coincidence detection circuit 23.

Figure 4:
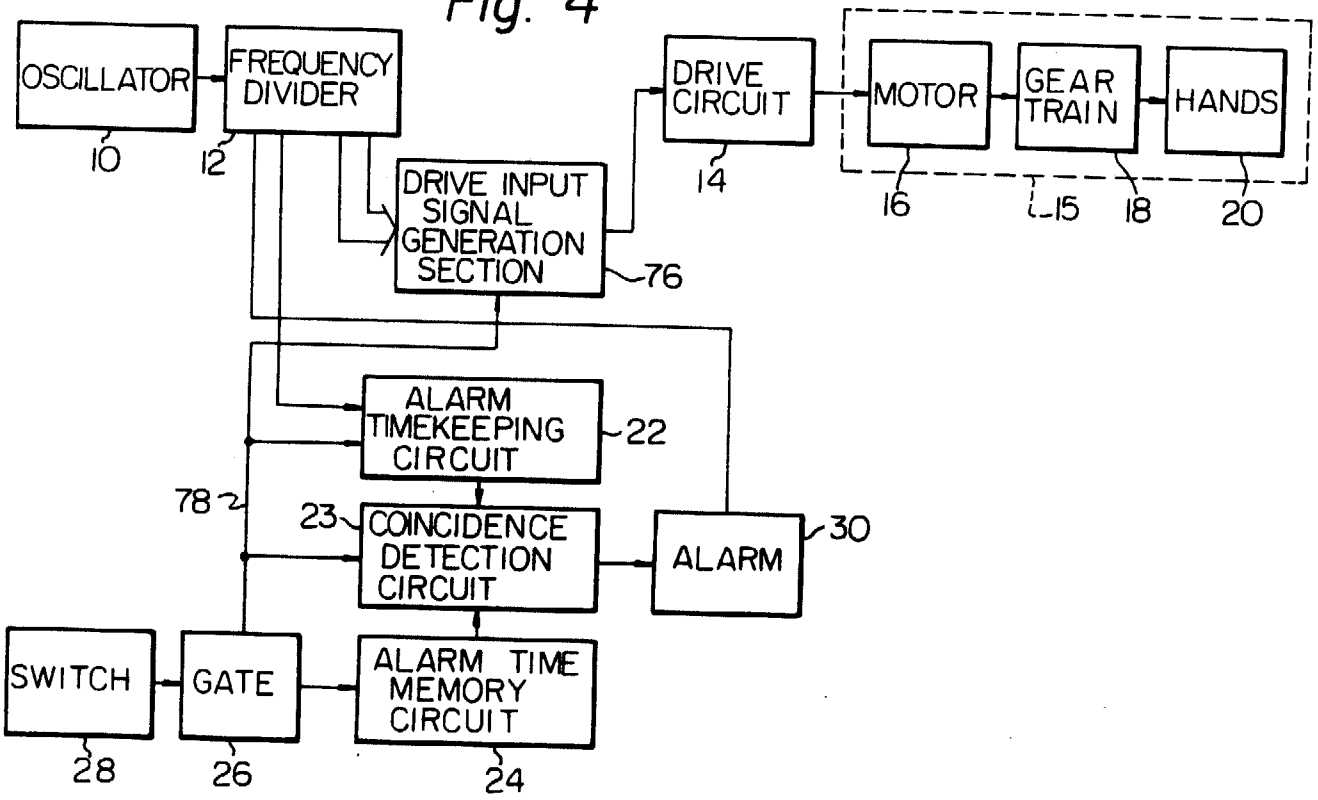
FIG. 4 is a general block diagram of a second preferred embodiment of the present invention.

FIG. 4 is a block diagram of a second preferred embodiment of the present invention. This is similar to the first embodiment described above, but further includes means for indicating to the timepiece user that the timepiece is in the alarm time setting mode. This is done by deriving the drive signal to be applied to drive circuit 14 from a drive input signal generation section 76. Drive input signal generation section 76 is controlled by a signal produced by gate circuit 26, to generate a drive input signal by combining various signals supplied from frequency divider circuit 12, the waveform of the drive input signal being varied depending upon whether the timepiece is in the normal timekeeping mode or in the alarm time setting mode. As a result, the motion of timekeeping hands 20 is varied depending upon whether the timepiece is in the alarm time setting mode or not, so that the timepiece user is notified of the mode of operation of the timepiece.

Figure 5:
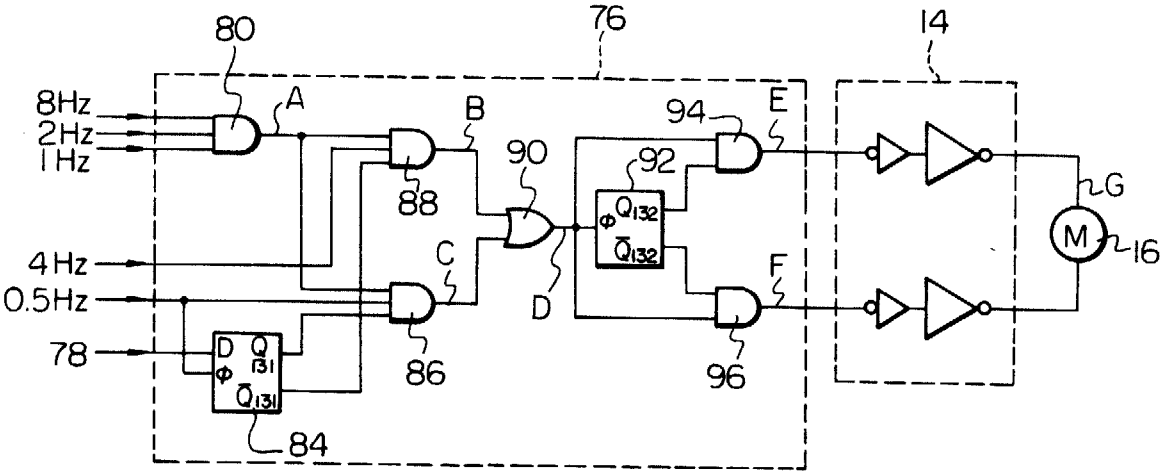
FIG. 5 is a general circuit diagram illustrating a drive signal generation section in the second preferred embodiment.
Figure 6:
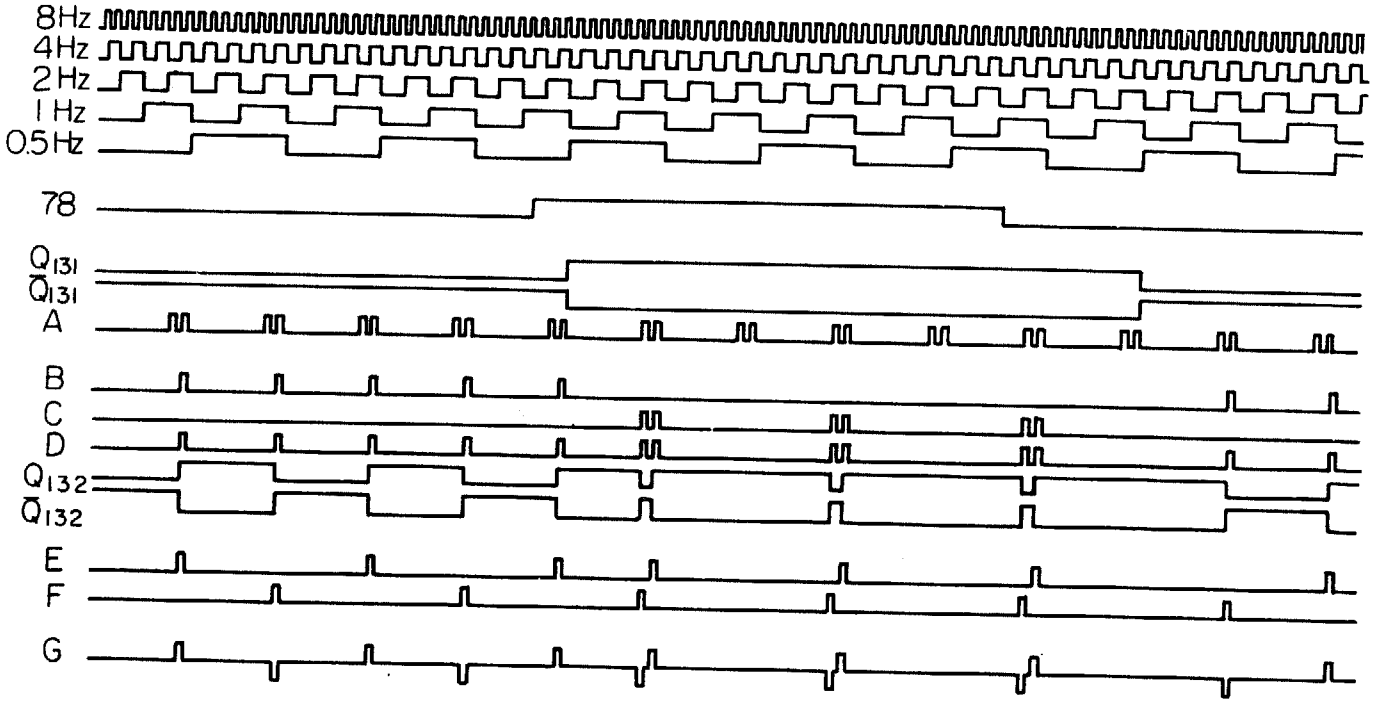
FIG. 6 is a waveform diagram illustrating signal waveforms for the circuit of FIG. 5.

A possible configuration for drive input signal generation section 76 is shown as a general circuit schematic in FIG. 5. The operating waveforms for the circuit of FIG. 5 are shown in the waveform diagram of FIG. 6. Referring now to FIG. 5, pulse train signals with frequencies of 8 Hz, 2 Hz and 1 Hz are input to AND gate 80, which produces an output signal comprising pairs of pulses with a period between each pair of 1 second, as shown in FIG. 6. Output signal A from AND gate 80 is combined with a 4 Hz signal and the $\overline{Q}$ output of a data-type flip-flop 84 in AND gate 88. Thus, as shown in FIG. 6, when the $\overline{Q}$ output of flip-flop 84 is at the H level, a train of single pulses with a period of one second is produced by AND gate 88. When the $\overline{Q}$ output of flip-flop 84 goes to the L level, then AND gate 88 is inhibited, so that no pulses are output, i.e. signal B remains at the L level.

Output signal A from AND gate 80 is also applied to AND gate 86, together with a 0.5 Hz signal having the waveform shown in FIG. 6, and the Q output of flip-flop 84. As a result, when the Q output of flip-flop 84 is at the H level, an output signal comprising pairs of pulses with a period of 2 seconds between each pair is produced from AND gate 86. When the Q output of flip-flop 84 is at the L level, no output is produced from AND gate 86, i.e. its output remains at the L level. The output from AND gate 86, designated signal C, and signal B from AND gate 88, are applied to an OR gate 90, the output of which is designated as signal D and is connected to inputs of AND gates 94 and 96, and to the clock terminal of a toggle-type flip-flop 92. Signal D comprises a train of single pulses separated by a period of one second, when the Q output of flip-flop 84 is at the L level, and a train of pairs of pulses separated by a period of two seconds when the Q output of flip-flop 84 is at the H level. The Q and $\overline{Q}$ outputs of flip-flop 92 switch alternately between the H and the L levels in response to successive clock pulses supplied from OR gate 90. Thus, the D signal pulses from OR gate 90 are alternately gated through AND gate 96 and AND gate 94. Outputs E and F of AND gates 94 and 96 respectively are amplified in drive circuit 14, and applied to opposite ends of the coil of motor 16, so that a voltage having the waveform shown as G in FIG. 6 appears across the coil of motor 16.

Thus, when the timepiece user actuates switch 28 to put the timepiece into the alarm time setting mode, output signal 78 from gate circuit 26 goes to the H level. As a result, the 0.5 Hz clock signal applied to data-type flip-flop 84 causes the Q output of flip-flop 84 to go to the H level upon the next L to H level transition of the 0.5 Hz signal. This causes signal G applied to the motor to change from a train of single alternately positive and negative pulses, driving the seconds hand of the timepiece once per second, to a train of pairs of alternately positive and negative pulses, driving the seconds hand twice every two seconds. The seconds hand is therefore caused to jump forward by two seconds of scale graduation, every two seconds. The timepiece user is thereby notified that the timepiece is in the alarm time setting mode.

Various modifications of the preferred embodiments of the present invention described above can be contemplated. For example, switches 32 and 34 can comprise two mechanically and electrically independent switches. An LED can be incorporated into the timepiece to provide a flashing type of visible warning signal when the alarm time setting mode is entered. LED or liquid crystal photo-electric display means can be provided to display the contents of the alarm time memory circuit, to facilitate the process of setting in an alarm time. A buzzer can be caused to emit one type of periodic warning signal when the timepiece is in the alarm time setting mode, and another type of warning signal when alarm time coincidence is detected, etc. However, it will be apparent that all such modifications will fall within the scope of the present invention.

What is claimed is:

1. An electronic timepiece comprising, in combination:

a source of standard frequency signal;

drive circuit means responsive to said standard frequency signal for producing a drive signal;

a motor driven by said drive signal;

time indicating hands driven by said motor to indicate current time;

an alarm system including at least one external operating member, switch means coupled to said external operating member, alarm timekeeping circuit means responsive to said standard frequency signal for counting at least the hours of time, alarm time memory circuit means responsive to a signal generated by actuation of said external operating member for counting and storing at least the hours of alarm time, coincidence detection circuit means coupled to said alarm timekeeping circuit means and to said alarm time memory circuit means for generating a coincidence signal when the contents of said alarm timekeeping circuit means and of said alarm time memory circuit means become identical, alarm signal generation means responsive to said coincidence signal for generating an alarm signal, and gate circuit means coupled to said switch means and responsive to actuation of said external operating member for resetting said alarm timekeeping circuit means and said alarm time memory circuit means and for applying an input alarm time count into said alarm time memory circuit; and drive input signal generation means coupled between said source of at least one standard frequency signal and said drive circuit means and responsive to said standard frequency signal and a control signal from said gate circuit means for generating a first drive input signal applied to said drive circuit means when said electronic timepiece is in a normal timekeeping mode of operation and for generating a second drive input signal applied to said drive circuit means when said electronic timepiece is in an alarm time setting mode of operation, said first drive input signal and said second drive input signal having different waveforms.

2. An electronic timepiece comprising, in combination:

a source of standard frequency signal;

drive circuit means responsive to said standard frequency signal for producing a drive signal;

a motor driven by said drive signal;

time indicating hands driven by said motor to indicate current time;

an alarm system including at least one external operating member, switch means coupled to said external operating member, alarm timekeeping circuit means responsive to said standard frequency signal to provide an alarm time information signal representing alarm time other than said current time, alarm time memory circuit means responsive to a signal generated by actuating of said external operating member for setting a signal indicative of a time difference between said current time and said alarm time, coincidence detection circuit means coupled to said alarm timekeeping circuit means and to said alarm time memory circuit means for generating a coincidence signal when said time difference between said current time and said alarm time becomes zero value, alarm signal generation means responsive to said coincidence signal for generating an alarm signal, and gate circuit means coupled to said switch means and responsive to actuation of said external operating member for resetting said alarm timekeeping circuit means and said alarm time memory circuit means and applying an input alarm time count into said alarm time memory circuit; and drive input signal generation means coupled between said source of at least one standard frequency signal and said drive circuit means and responsive to said standard frequency signal and a control signal from said gate circuit means for generating a first drive input signal applied to said drive circuit means when said electronic timepiece is in a normal timekeeping mode of operation and for generating a second drive input signal applied to said drive circuit means when said electronic timepiece is in an alarm time setting mode of operation, said first drive input signal and said second drive input having different waveforms.

* * * * *